US005918830A

United States Patent [19]

Veräjänkorva et al.

[11] Patent Number: 5,918,830

[45] Date of Patent: Jul. 6, 1999

[54] REELING DEVICE AND METHOD IN REELING OF A PAPER WEB OR EQUIVALENT

[75] Inventors: Janne Veräjänkorva, Espoo; Teppo Kojo; Sami-Jussi Airiola, both of Järvenpää, all of Finland

[73] Assignee: Valmet Corporation, Helsinki, Finland

[21] Appl. No.: 09/023,988

[22] Filed: Feb. 13, 1998

[30] Foreign Application Priority Data

Feb. 13, 1997 [FI] Finland ..... 970610

[51] Int. Cl.[6] ..... B65H 16/10; B65H 18/04; B65H 18/10; B65H 18/22

[52] U.S. Cl. ..... 242/541.1; 242/532.2; 242/541.3; 242/564.5

[58] Field of Search ..... 242/541.1, 541.3, 242/541.4, 541.5, 541.6, 541.7, 542.3, 564.5, 532.2, 422.6, 422.7, 422.8, 420.2, 420.3, 547

[56] References Cited

U.S. PATENT DOCUMENTS

| | | | |
|---|---|---|---|
| 3,098,619 | 7/1963 | Washburn | 242/541.3 |
| 3,471,097 | 10/1969 | Phelps | 242/541.3 |
| 3,687,388 | 8/1972 | Pfeiffer | 242/541.4 |
| 3,698,658 | 10/1972 | Skei | 242/541.3 |
| 4,034,928 | 7/1977 | McDonald et al. | 242/541.1 |
| 4,143,828 | 3/1979 | Braun et al. . | |
| 4,277,032 | 7/1981 | Alberto et al. | 242/541.3 |
| 4,283,023 | 8/1981 | Braun et al. | 242/541.3 |
| 4,632,325 | 12/1986 | Feyerl et al. | 242/547 |
| 4,746,076 | 5/1988 | Tomma et al. . | |
| 4,830,304 | 5/1989 | Fuke et al. . | |
| 4,921,183 | 5/1990 | Saukkonen et al. . | |
| 5,058,820 | 10/1991 | Ito et al. | 242/541.1 |
| 5,150,850 | 9/1992 | Adams . | |
| 5,285,979 | 2/1974 | Francesco | 242/541.7 |
| 5,393,008 | 2/1995 | Kyytsonen et al. | 242/541.1 |
| 5,531,396 | 7/1996 | Kinnunen et al. | 242/541.3 |
| 5,785,271 | 7/1998 | Leskinen et al. | 242/541.5 |

FOREIGN PATENT DOCUMENTS

| | | |
|---|---|---|
| 74260 | 5/1987 | Finland . |
| 81768 | 11/1988 | Finland . |
| 2721881 | 11/1978 | Germany . |

*Primary Examiner*—John M. Jillions
*Attorney, Agent, or Firm*—Steinberg & Raskin, P.c.

[57] ABSTRACT

A reeling device including a reel drum supported on reeling rails and around which a paper web is reeled into a reel through a reeling nip defined between a set of belt rolls and the reel. The set of belt rolls extends in the cross direction substantially across the web width. A method for reeling or unwinding a paper web in which the paper web is reeled around a reel drum supported on reeling rails into a reel or unwound from the reel by means of a reeling nip. The paper web is reeled through the reeling nip which is formed between at least one set of belt rolls extending in the cross direction substantially across the web width and the reel that is being formed/unwound.

29 Claims, 4 Drawing Sheets

REELING DEVICE AND METHOD IN REELING OF A PAPER WEB OR EQUIVALENT

FIELD OF THE INVENTION

The present invention relates to a reel-up or reeling device including a reel drum supported on reeling rails or equivalent, and around which a paper web or equivalent is reeled into a reel through a reeling nip.

The present invention also relates to a method in reeling of a paper web or equivalent, in which the paper web or equivalent is reeled around a reel drum supported on reeling rails into a reel, or unwound from a reel drum, by means of a reeling nip.

BACKGROUND OF THE INVENTION

A traditional reel-up is based on loading of a reel drum, and a paper reel being formed on the reel drum, against a reeling cylinder, and the construction of a prior art reel-up is often complicated. The reeling result achieved by means of prior art reel-ups is also often inadequate.

In a reel-up, one of the factors for selecting the control has been the web tension that affects the quality of reeling, and in some prior art constructions, center drive of the reel drum has also been employed in order to compensate for the linear load and for loads disadvantageous for the structure of the reel, which loads have mainly arisen from the mass of the reel increasing along with the progress of reeling. It has been noticed that the linear load effective in the reeling nip formed by the reeling cylinder and the reel that is being formed is the most efficient reeling parameter in consideration of the reel hardnesses that are achieved. In prior art constructions, the control of the reeling nip and the linear load has been limited primarily to regulation of the level of loading alone.

With the present-day technology, the control of unwinding that is achieved by means of unwind stands is partly inadequate, which is emphasized further with increasing reel diameters. Particularly high requirements are imposed by any slowing down and acceleration of the reel, in which case, besides the structure of the reel, these situations must be adequately controlled, which is often difficult to achieve.

The present-day unwind stands are typically based on utilization of a center drive coupled with the reel drum. At the beginning of unwinding, the reel is accelerated by means of the center drive, and at the running speed the drive performs a slight braking in order to maintain and to regulate the web tension. Problems of regulation are caused by the large mass of the roll and by possible non-roundness. The reel is supported on the reeling rails from the bearing housings of the reel drum only, which causes a disadvantageous loading in particular of the bottom layers of the reel, which arises from bending of the reel drum and from the mass of the reel and which increases the risk of formation of bottom broke.

An increased diameter of the paper reel that is formed by means of the reel-up increases the efficiency of the reel-up and the whole line of paper manufacture, provided that the loads that are produced by the increased reel mass and that are unfavorable for the structure of the reel can be controlled and kept at a sufficiently low level. Likewise in unwinding, the running of the process can be affected in a positive way if the control of the nip load can be influenced in an efficient way.

OBJECTS AND SUMMARY OF THE INVENTION

It is an object of the present invention to control the loads effective in the reeling nip during reeling.

One future challenge in reeling will be achieving a good reeling result with increasing running speeds. Along with increasing running speeds, in particular the problems of air in the reeling up, i.e., mainly the problems arising from air which travels along with the web that is being reeled entering into the reel, are increasing constantly, and thus, it is an object of the invention to provide an arrangement in which these problems have been eliminated or at least minimized.

It is a further object of the invention to provide a reeling device whose construction is simple, whereby a smaller amount of raw-material for the manufacture and a simpler system of control as well as a shorter installation time are achieved.

It is a further object of the invention to suggest solutions for future challenges of both unwinding and reeling up so that, in the reeling device in accordance with the present invention, the structure of the reel can be controlled more precisely than in the prior art.

In view of achieving the objects stated above and others, the reeling device in accordance with the invention includes a reel drum arranged such that the web is passed through a reeling nip and reeled onto the reel drum to form a reel, support means for supporting the reel drum, e.g., a support rail arranged at each side of the reeling device, and at least one set of belt rolls extending in a cross direction of the reel device substantially across a width of the web and arranged to engage the web at least as the web is being reeled onto the reel drum such that the set of belt rolls defines in part the reeling nip.

The method in accordance with the invention for reeling or unwinding a paper web includes the steps of supporting a reel drum on reeling rails, reeling the web around the reel drum to form a reel or unwinding the web from a reel by passing the web through a first reeling nip, and forming the first reeling nip between a first set of belt rolls extending in a cross direction of the reel drum substantially across a width of the web and the reel at least as the web is being reeled onto the reel drum or is being unwound from the reel.

In accordance with the invention, when a reeling cylinder is substituted for by a set of belt rolls, on one hand, the controllability of the reeling nip is improved. When belt support of the paper reel that is being formed is employed, which support is achieved by means of a set of belt rolls, the nip pressures in the reeling nip remain considerably lower than with traditional reel-ups, because the nip is considerably longer and a belt as a material is softer than a reeling cylinder made of cast iron, in which case the loading profile of the nip effect is more even. In the arrangement in accordance with the invention, it is also possible to regulate the nip pressure by varying the belt tension while the loading remains at the same level. In a reel-up of a wide machine, in which the set of belt rolls is preferably composed of several separately adjustable parts, it is possible to utilize profiling of the nip load in the cross direction when the parts of the set of rolls are arranged so that they can be loaded independently.

Preferably, in accordance with the invention, the belts that are used in the set of belt rolls are such that a sufficient/suitable friction between the belt and the web can be achieved. The belts can be permeable or impermeable to air. In the set of belts, it is also possible to use both belt sorts as appropriately distributed.

According to the invention, the reel drum is supported on rails and/or on a set of belt rolls so that the desired nip force is produced. In each mode, the distribution of loading can vary within the range 0% to 100%.

In an arrangement in accordance with the invention, instead of one set of belt rolls, there may also be two sets of belts rolls placed one after the other, in which case, independent and different functions can be assigned to the different sets of rolls, such as, for example, binding the surface, initial acceleration, and slowing down of a complete machine reel. By means of two sets of belt rolls placed one after the other, two simultaneous reeling nips are also provided.

According to a preferred embodiment of the invention, the belt support in accordance with the invention is utilized when unwinding a reel. The belt support may operate independently or together with center drive. When unwinding in accordance with the invention, a support of the reel across the entire width and an extended nip of ample web-hold qualities provided by the set of belts are achieved. By means of a resilient set of belts and by means of a suitable coverage of the set of belts, the outlet angle of the web unwound from the reel can be made invariable, and thereby it is possible to attenuate variations in web tension arising, e.g., from non-roundness of the reel.

The set of belts is preferably mounted so that, when viewed in the machine direction, its first end is stationary and the second end is displaceable in relation to the first end. Preferably, a hydraulic cylinder or an equivalent actuator is used for regulation of the height of the second end. The loading of the set of belts can be controlled, for example, by means of a feedback of force or in compliance with measurement of the location of the set of belts by means of position regulation. Thus, the constructions suggested within the scope of the invention can be applied both to unwinding and to reeling up even though the constructions are described herein mainly with reference to reeling up.

According to a preferred embodiment of the invention, the reeling device comprises measurement and/or control and/or storage members, which record and/or store information concerning the reeling process. This information can be, among other things, information on the belt tension, on control of the belt tension, on a relief force, on control of the relief force, on the mass of the reel and/or on the non-roundness of the reel, on the position of the reeling carriages. In particular, the belt tension and the relief force are to be understood as a separate information/control related to a single unit of a set of belt rolls, a number of such units being possibly fitted in the cross direction of the web. The measurement data can also be some other reeling parameter. The measurement data can be used for controlling the reeling process during reeling, but the measurement data can also be transmitted further to other stages of the process as a control parameter. The data can also be stored specifically for each reel, in which case, for example, in unwinding it is possible to utilize the individual reel-up data of each machine reel, for example, in connection with its unwinding. In this way, favorably, in unwinding it is possible to take into account the cross-direction profile of the reel as a function of the reel diameter in unwinding, for example, by loading and/or relieving the reel by means of the set of belts so that the loading and/or the relief profile corresponds to that used in reeling up.

In accordance with the invention, in reeling, it is also possible to use a suitable combination of center drive and circumferential drive provided by means of belts.

In a reel-up in accordance with the invention, a single set of belt rolls comprises one or more belts, in which case the operation of the reel-up does not necessarily depend on a single belt. The set of rolls is mounted preferably at the rear end, i.e., at the end next to the dry end, on the frame of the reel-up, and at the forward end there is a hydraulic cylinder or an equivalent actuator, by whose means the set of rolls can, among other things, be raised and lowered for passing a reel drum. By means of the actuator, it is also possible to regulate the position of the set of belt rolls in the vertical direction and the loading/relieving in compliance with the stage of reeling.

Substitution for a reeling cylinder by a set of belt rolls in accordance with the invention also permits bringing of the stock of reel drums to the level of the reeling rails, which lowers the number of parts in the reel-up, increases the rigidity of the reel-up, and simplifies the sequence of operation of the reel-up and makes said sequence quicker. At the same time, the risks related to falling down in connection with lowering of reel drums are eliminated. The construction of the reel-up in accordance with the invention readily also permits connecting of the reel-up to the end of a paper or coating machine or some other finishing machine based on a supported web draw. If necessary, in connection with a set of belt rolls in accordance with the invention, it is possible to provide an air doctor or equivalent to keep the belts clean and to prevent winding of the web around the set of belt rolls.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1A:
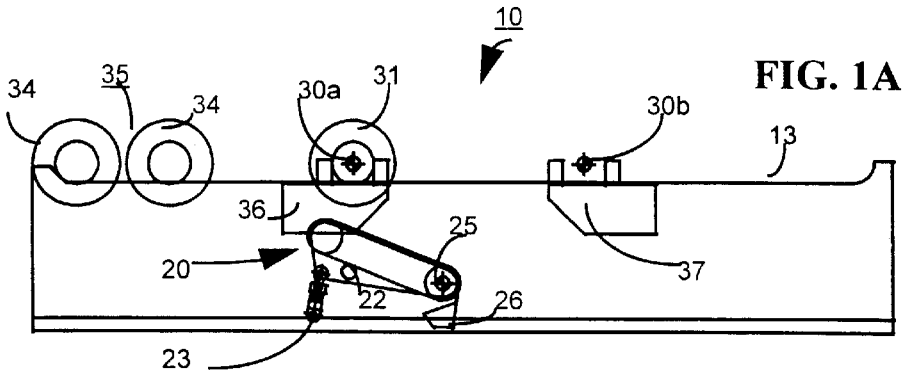
FIGS. 1A, 1B, 1C and 1D are schematic illustrations of a reel-up in accordance with the invention viewed in the longitudinal direction of the web in different stages of reeling.

Referring to the accompanying drawings wherein like reference numerals refer to the same or similar elements, as shown FIGS. 1A–1D, in a reel-up designated generally as 10, a paper web or equivalent material web is reeled into a paper reel 12 about a reel drum 31 by means of a set of belt rolls 20, which as described in the non-limiting manner herein comprises at least two rolls and at least one rotatable belt arranged to run in a loop over the rolls. Specifically, the web is passed through a reeling nip N formed between the reel 12 that is formed and the set of belt rolls 20 onto the reel drum 31 such that the reel 12 forms on the reel drum 31. In the stock 35 of reel drums in the reel-up 10, there are empty reel drums 34 in a waiting position. In the reeling stage, the reel drum 31 is provided with center drive 30*a*, 30*b* to enable rotation of the same. The reel drum 31 of the paper reel 12 is supported in the cross direction on reeling rails 13 or equivalent support members by means of reeling carriages or sledges 36,37 or equivalent.

In the stage shown in FIG. 1A, the reel-up 10 is in a stand-by stage. The reel drum 31 has been shifted to the reeling position, but the set of belt rolls 20 has not yet been raised to form the reeling nip N with the reel drum 31. A primary reeling sledge 36 is arranged to support the reel drum 31, and a secondary reeling sledge 37 is still empty. The reel drum placed on the primary reeling sledge 36 can be coupled with the primary center drive 30*a,* and the reel drum placed on the secondary reeling drum 37 can be coupled with the secondary center drive 30*b*.

Figure 1B:
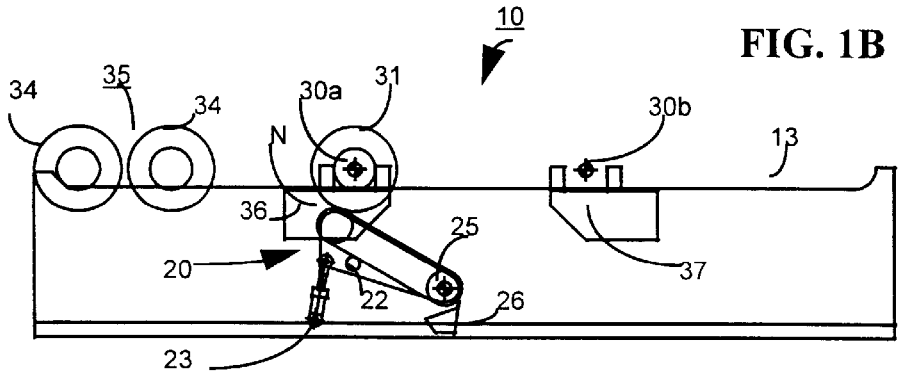

In the stage shown in FIG. 1B, the paper web or equivalent is ready to be passed through the reeling nip N formed between the set of belt rolls 20 and the reel drum 31 to be reeled around the reel drum 31 into a paper reel.

Figure 1C:
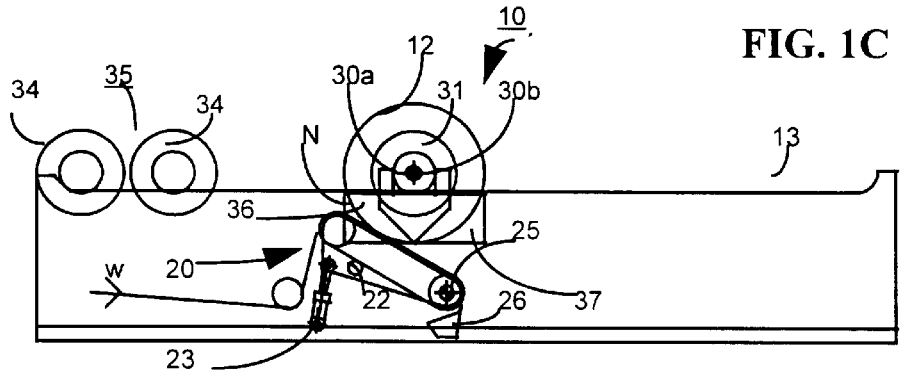

In the stage shown in FIG. 1C, the reeling of the paper web W or equivalent has been started and makes progress, and the reel drum 31 has moved forward on the reeling rails 13 or equivalent, and the reeling nip N is formed between the set of belt rolls 20 and the paper reel 12 that is being formed. The intensity of the nip load is regulated by placing the set of belt rolls 20 in the desired position in relation to the reel 12. At this stage, the drives are also changed, in which connection the primary center drive 30*a* is replaced by the secondary center drive 30*b*. At this stage the support of the reel is also shifted from the primary reeling sledge 36 to the secondary reeling sledge 37. In FIG. 1C, a stage is shown in which both sledges are in connection with the reel drum 31. After this, the primary center drive 30*a* and the primary reeling sledge 36 become free for fetching the next reel drum 31',34.

Figure 1D:
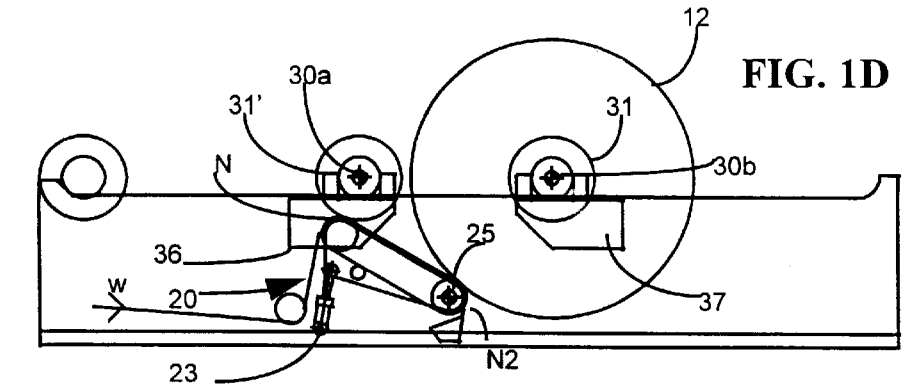

In the stage shown in FIG. 1D, the following reel drum 31' with its center drive 30*a* has been brought to the vicinity of the set of belt rolls 20 to the reeling position, and between the drum 31' and the set of belt rolls 20 there is the reeling nip N. The paper reel 12 that is being completed is also in reeling nip contact N2 with the set of belt rolls 20. As is shown in FIG. 1D, the construction of the set of belt rolls 20 permits the change, during which both the paper reel 12 that is being completed and the new reel drum 31' are both in nip contact with the set of belt rolls 20, and the web is fully supported. In this situation, the reel 12 that is being completed is preferably in engagement with the secondary center drive 30*b* and the new reel drum 31' in engagement with the primary center drive 30*a*. In connection with the invention, if necessary or if desired, it is also possible to use a band change device or other solutions for changing the reeling of the web from completed reel 12 to the empty reel drum 31'.

The set of belt rolls 20 in accordance with the invention is provided with a tension regulation member 22, by whose means the nip pressure effective during reeling is regulated by regulating the tension of the belts 24. The set of belt rolls 20 is provided with a hydraulic cylinder 23 or with an equivalent actuator, by whose means the position of the set of belt rolls 20 in the direction of height can be regulated. The actuator 23 is connected to one end of the set of belt rolls 20, and the opposite end of the set of belt rolls is linked by means of an articulated joint 25 with the frame constructions or foundations of the reel-up 10. Moreover, in connection with the set of belt rolls, an air doctor 26 or equivalent cleaning device is fitted, which keeps the belts 24 of the set of belt rolls 20 clean and prevents winding of the web around the set of belt rolls 20.

Figure 2:
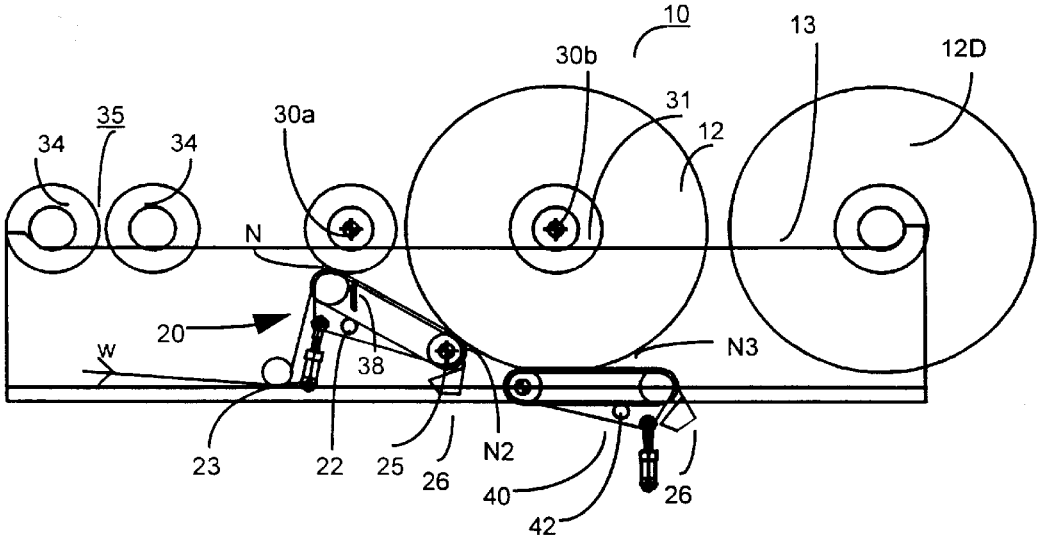
FIG. 2 is a schematic illustration of a second reel-up in accordance with the invention viewed in the longitudinal direction of the web.

In connection with the reel-up 10 shown in FIG. 2, as viewed in the running direction of the web, in addition to the set of belt rolls 20, a second set of belt rolls 40 has been provided. In this exemplifying embodiment, individual and different functions can be assigned to each of the sets of belt rolls 20,40, for example, in relation to binding the surface of the web, initial acceleration, slowing down the complete machine reel, etc. In addition to this, if necessary, two reeling nips N2 and N3 are produced at the same time for the same paper reel 12. In FIG. 2, the reel-up 10 is illustrated in a reeling situation substantially corresponding to FIG. 1D. The set of belt rolls 40 has been attached to the frame constructions or foundations of the reel-up 10, and it may comprise one or more belts in the cross direction of the web. For regulation of the tension of the belts, there is a tension regulation member 42. In respect of its basic construction, the set of belt rolls 40 can, if necessary, also be different from the set of rolls 20, for example provided with no actuator 23. The set of belt rolls 40 can also be provided with a drive. In the construction of FIG. 2, a blow device 38 is also shown, which will be described in more detail in relation to FIG. 5. This set of belt rolls 40 can also be provided with a doctor or equivalent.

Figure 3:
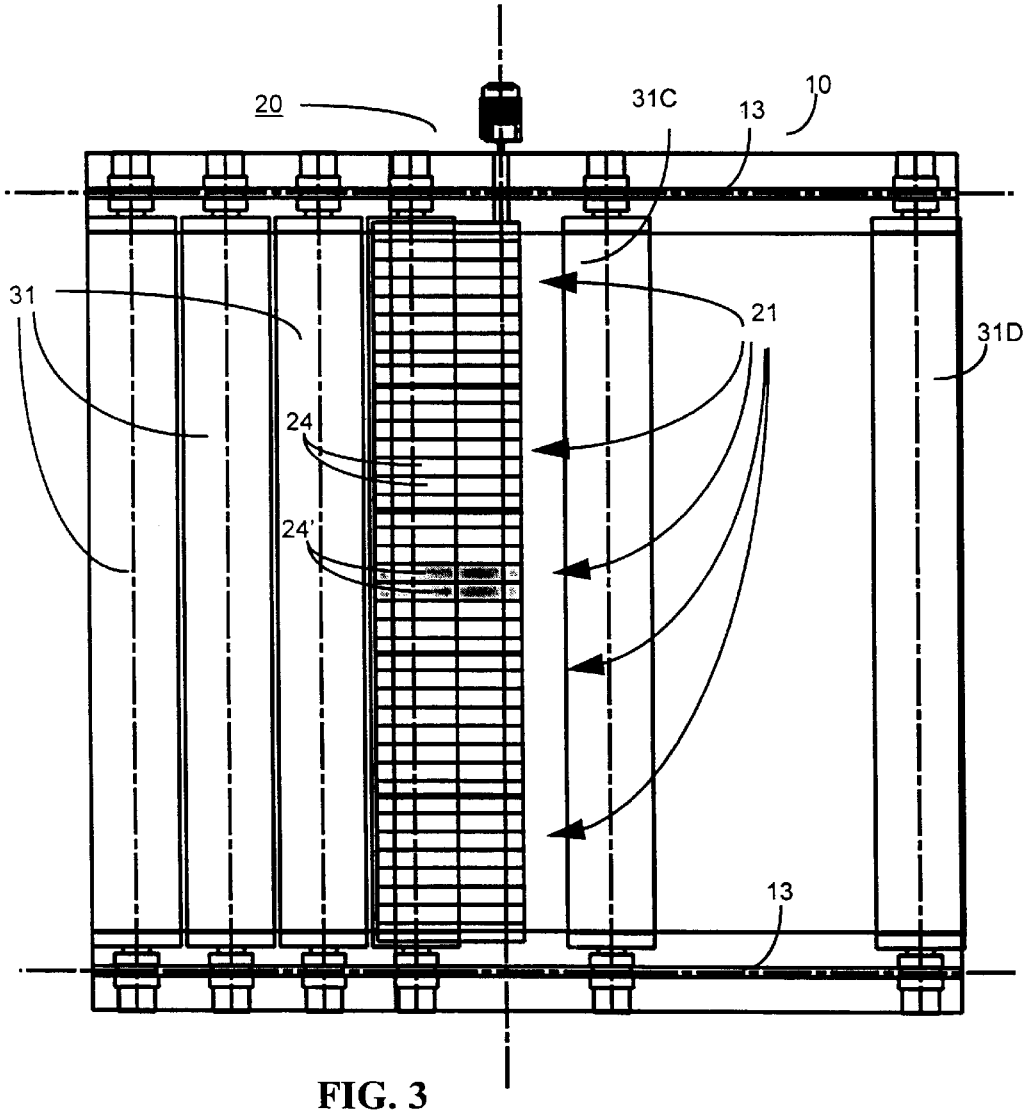
FIG. 3 is a schematic illustration of a reel-up in accordance with the invention viewed from above.

As shown in FIG. 3, each set of belt rolls 20 is preferably comprised of a number of modules 21 in the cross direction, in which case, either between the modules 21 or in place of a single belt 24 or at or below such a belt, it is possible to install a stationary lower blow pipe 38, by whose means the reel change and threading are carried out, preferably as of full width. If necessary, there may also be several pipes in the cross direction of the web. The medium that is blown is air, water or an adhesive or solid matter. An advantage of water is the effect of binding the surface sheets on a complete paper reel, in which case a rider device is not necessarily needed.

Figure 5:
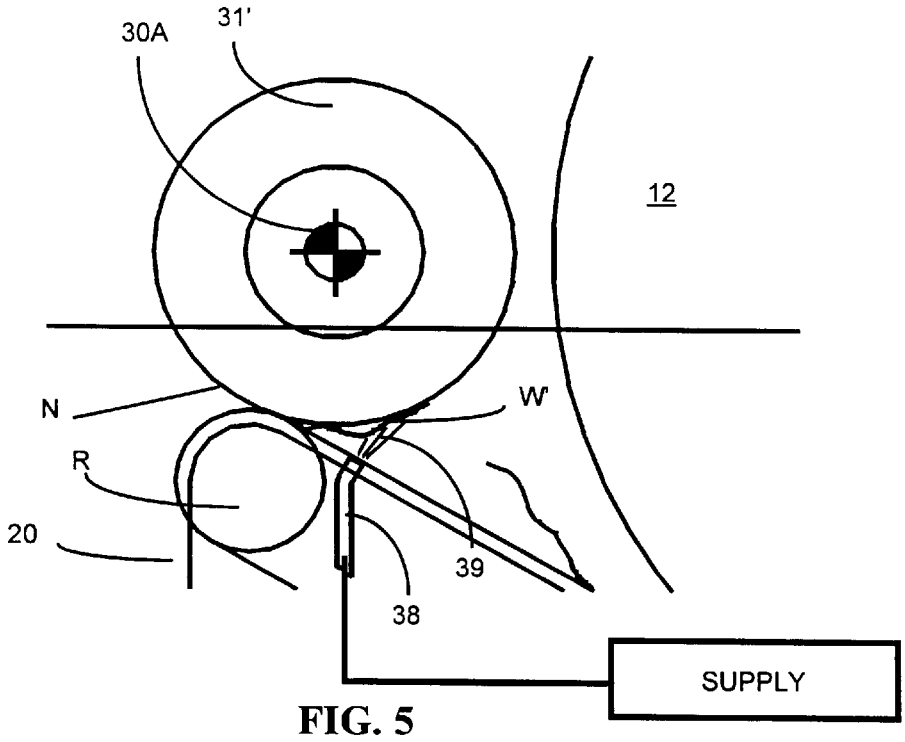
FIG. 5 is a schematic illustration of the change process in a reeling device in accordance with the invention.

Thus, in FIG. 5, a favorable reel change process in accordance with the invention is illustrated. The change can be carried out in a way in itself known, but preferably so that, by means of a blow pipe or equivalent air directing member 38 placed in connection with the set of belt rolls (herein just one pipe is shown, but there may also be several pipes in the cross direction), the web is cut off and/or a cut-off web is guided around the new reel drum 31' and further into the nip N. The reel 12 that is being completed has been transferred into a position which permits the introduction of the new reel drum 31' into nip connection with the set of belt rolls 20. The new reel drum 31' has been accelerated to the web speed before it is brought into contact with the web. The change process is carried out preferably so that, at least substantially directly after the change, the initial reeling is carried out preferably against the roll R of the set of belts for a certain period of time. In the change process itself, the blowing is carried out preferably so that the end W' of the cut-off web substantially maintains its speed and is guided in the direction of the face of the reel drum 31'. The change can also be carried out when the reel drum 31' forms a nip with the set of belts only, in which case the change blowing can be directed even more closely into the nip between the reel 31' and the set of belts substantially simultaneously almost in the direction of the tangent of the roll. The blow pipe communicates with a source of blow medium through suitable ducts.

As shown in FIG. 3, each of the modules 21 in the set of belt rolls 20 comprises a number of belts 24, whose tension can be regulated either individually or jointly by means of the belt tension regulator 22. By means of the tension of the belts 24, it is possible to affect the nip pressure effective in the reeling. The belts used in the set of belt rolls 20 can be permeable to air (represented by belts 24') or impermeable (represented by belts designated 24). Even though in FIG. 3, belts impermeable to air have been shown in the middle area of the set of belts, this is by no means supposed to confine the locations of the permeable belts and impermeable belts to those shown in the illustrated embodiment, but rather, the illustrated embodiment shows merely one example of the placement of different types of belts. Under these circumstances, the properties of the belts in the set of belts and the positions of the belts in the cross direction are selected in the manner in compliance with the requirements imposed in each particular case.

In reeling up in accordance with an embodiment of the invention, in the initial stage of the running sequence of the belt support reel-up 10, the primary reeling sledge 36 is placed at the front (in the wet end) and the secondary reeling sledge 37 is placed at the rear (in the dry end). In the threading stage, a reel drum 34 is brought to the stock 35 and the holders are lowered and the reel drum 34 is passed to the stop position in the stock 35. The locking jaws of the primary reeling sledge 36 are closed, and the coupling of the primary-reel center drive 30*a* is closed. The set of belt rolls 20 is lowered, and the primary reeling carriage sledge 36 is passed to the reel-start position, FIG. 1A. After this, the set of belt rolls 20 is raised, arrows S in FIG. 1B, by means of the hydraulic cylinder/cylinders 23 or an equivalent actuator (s), and a joint starting of the drives 30*a*,25 is carried out (can also be started separately before the set of belt rolls 20 is raised). After threading of the lead-in strip, the web is widened to full width. If desired, a change blowing is blown and the initial reeling is carried out. The rear jaw of the second reeling sledge 37 is opened and the complete reel is delivered, after which the center drive 30*b* is switched to running when the diameter of the reel is suitable. The secondary reeling sledge 37 is switched to loading, and the front jaw of the reeling sledge is raised (change of linear load). The coupling of the secondary center drive 30*b* is closed (change of torque), and the coupling of the primary-reel center drive 30*a* and the locking jaws of the primary-reel carriage are opened, and the primary-reel carriage 36 is shifted to the front to fetch an empty reel drum. Preferably, the primary center drive 30*a* is arranged at the tending side of the reeling device 10, and the secondary center drive 30*b* is arranged at the driving side.

In constant running, first a reel drum 34 is brought to the stock 35 if there is no drum as yet, and the holders are lowered, and the reel drum 34 is passed to the stop position in the stock 35.

In a reeling process, the reel drum 31 of the reel 12 that is being completed is in connection with the secondary reeling sledge 37, and the secondary center drive 30*b* is in engagement, and the primary reeling sledge 36 is free to receive a new reel drum 31'. When the reel that is being completed is ready for being changed, the locking jaws of the primary reeling carriage 36 and the coupling of the primary-reel center drive 30*a* are closed early enough, and the primary-reel center drive 30*a* is switched to running. The set of belt rolls 20 is lowered by means of the actuator 23, and the primary-reel carriage is shifted to the reel start position. In this connection, the reel that is being completed is preferably all the time in nip contact with the set of belts. The set of belt rolls 20 is raised by means of the actuator 23, when the speeds are synchronized, the nip is closed and the change blowing is blown. After the change, the full reel is stopped, for example, with the aid of the center drive under control while, for example, the set of belts 40 shown in FIG. 2 supports the reel. Now the secondary reeling sledge 37 can be shifted to the new reel that is being completed. The rear jaw of the secondary reeling sledge is raised, and the center drive 30*b* is switched to running, and the secondary reeling sledge is switched to loading. The front jaw of the secondary reeling sledge is raised (change of linear load), and the coupling of the center drive 30*b* is closed (change of torque). The coupling of the primary-reel center drive 30*a* is opened, the locking jaws of the primary reeling carriage are opened, the primary reeling carriage is run to the front, etc.

Figure 4:
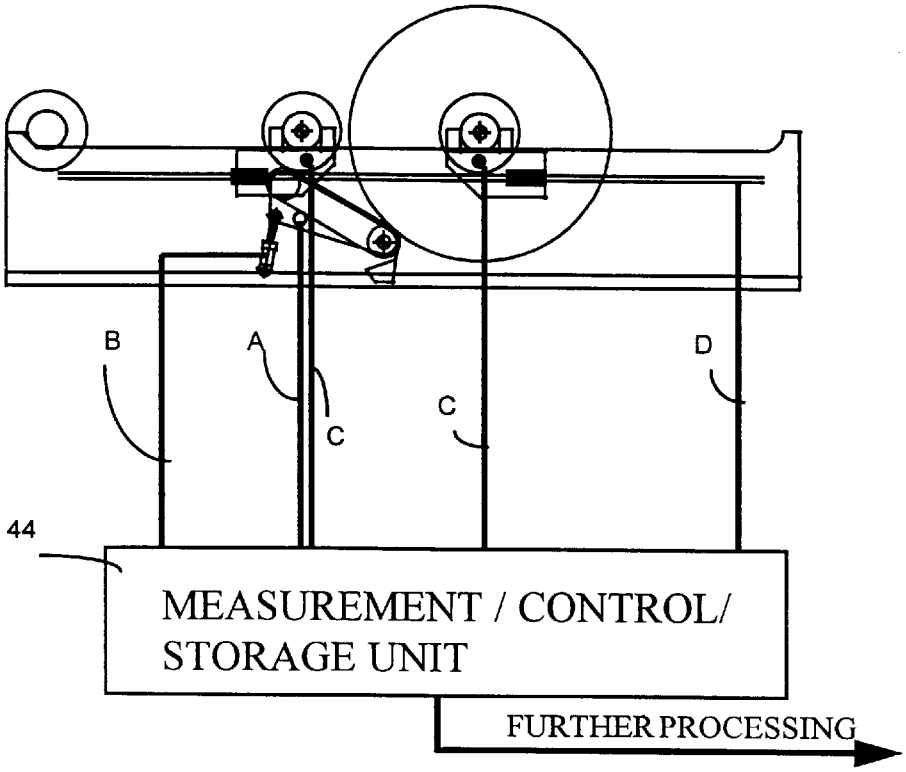
FIG. 4 is a schematic illustration of a mode in accordance with the invention for carrying out a reeling process in accordance with the invention.

FIG. 4 shows a preferred embodiment of the invention, in which the reeling device in accordance with the invention comprises measurement and/or control and/or storage members 44, which record and/or store information on the reeling process. The information can be, among other things, information on the belt tension and/or control of same A, on the relief force and/or control of same B, on the reel mass C, and/or on the position of the reeling carriage D. Information can also be collected concerning other reeling parameters. In particular, the belt tension A and the relief force B should be understood as separate data/control for a single unit of set of belt rolls, a number of such units being possibly provided in the cross direction of the web. The measurement data can be used for controlling the reeling process during the reeling, but the measurement data can also be transmitted further to other stages of the process as a control parameter. The data can also be stored specifically for each reel, in which case, for example, in unwinding it is possible to make use of the measurement data. In unwinding, the cross-direction profile of the reel as a function of the reel diameter can be taken into account, for example, by loading and/or relieving the roll so that the loading/relief profile corresponds to that used in the reeling up.

Figure 6:
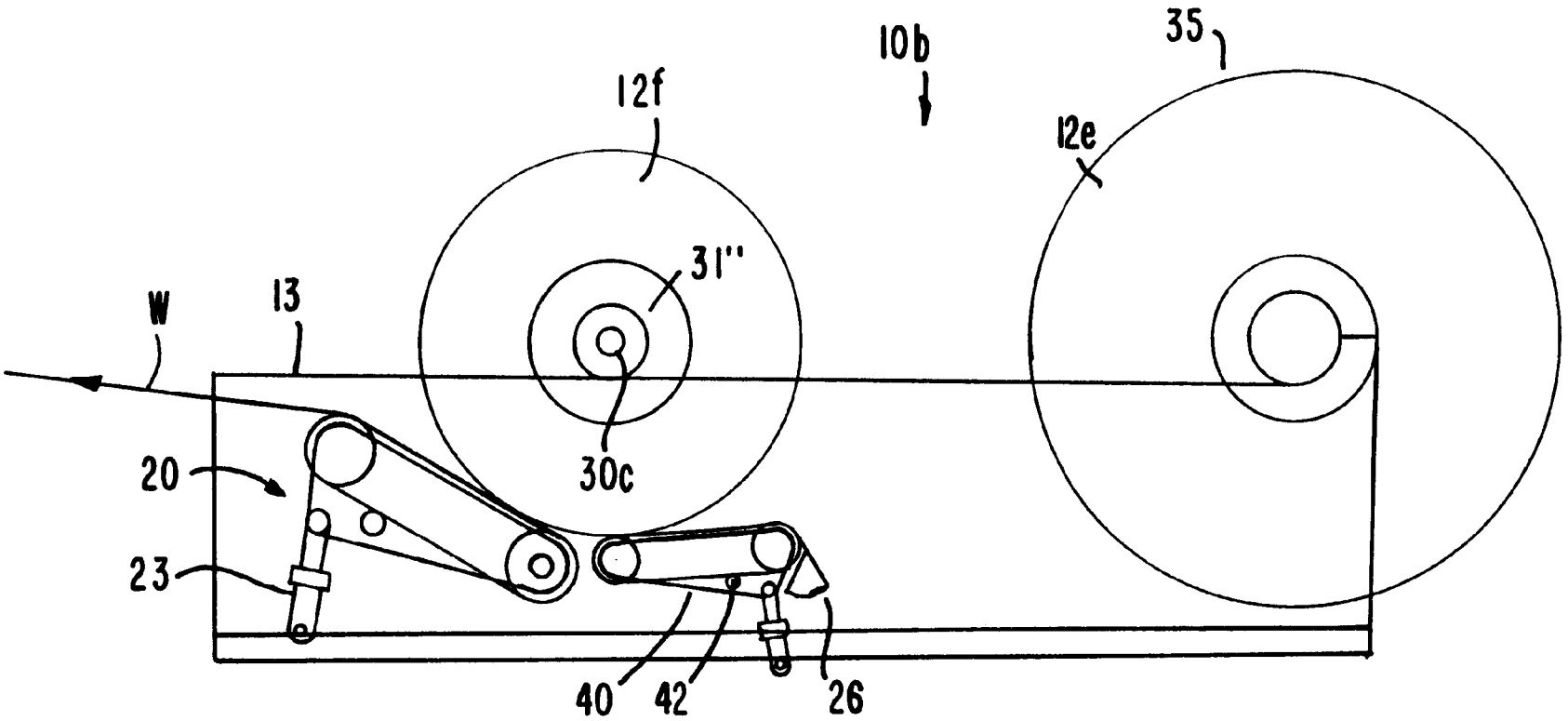
FIG. 6 is a schematic illustration of one mode in accordance with the invention for carrying out an unwind process in accordance with the invention.

FIG. 6 is a schematic illustration of a mode in accordance with the invention for carrying out the unwind process in accordance with the invention. It comprises elements corresponding to those in a reel-up. In the unwind stand 10*b*, the paper web W or equivalent is unwound from a machine reel 12*f* by means of, and supported by, a set of belt rolls 20 through an unwind nip N formed between the reel 12*f* and the set of belt rolls 20 to be fed further into a process of treatment of the paper or equivalent, such as calendering or coating (not shown). In the machine reel storage space 35 of the unwind stand 10*b*, there are machine reels 12*e* in the waiting position. In the unwind stage, if necessary, the reel drum 31" of the machine reel is provided with a center drive 30*c*. The reel drum 31" N of the paper reel 12*f* is supported in the cross direction on reeling rails 13 or equivalent by means of reeling carriages (not shown) or equivalent.

In unwinding, the properties of the invention can be utilized substantially similarly to the reeling up described above.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A reeling device in which a web is reeled, comprising a reel drum arranged such that the web is passed through a reeling nip and reeled onto said reel drum to form a reel, support means for supporting said reel drum, and at least one set of belt rolls extending in a cross direction of the reeling device substantially across a width of the web and arranged to engage the web, each of said at least one set of belt rolls comprising a plurality of modules, each of said modules comprising a plurality of belts and tension adjusting means for adjusting tension of said belts either individually or jointly.

2. The reeling device of claim 1, wherein said support means comprises a rail arranged on each side of said reel drum and said at least one set of belt rolls is arranged to engage the web at least as the web is being reeled onto said reel drum such that said at least one set of belt rolls defines in part said reeling nip.

3. The reeling device of claim 1, further comprising rotation means coupled to said reel drum for providing said reel drum with center drive.

4. The reeling device of claim 1, wherein said at least one set of belt rolls comprises first and second sets of belt rolls arranged one after the other in a running direction of the web.

5. The reeling device of claim 1, wherein each of said modules further comprises two rolls arranged such that said belts run in a loop around said two rolls.

6. The reeling device of claim 1, wherein at least one of said belts is permeable to air.

7. The reeling device of claim 1, wherein at least one of said belts is impermeable to air.

8. The reeling device of claim 1, wherein each of said at least one set of belt rolls comprises an actuator for displacing an end of said set of belt rolls to different positions relative to the web.

9. The reeling device of claim 1, further comprising a frame construction, each of said at least one set of belt rolls comprising articulated coupling means for linking said set of belt rolls to said frame construction by means of an articulated joint.

10. The reeling device of claim 2, further comprising a reel drum stock arranged to be supported by said reeling rails.

11. A method for reeling a web, comprising the steps of:

supporting a reel drum on reeling rails, reeling the web around said reel drum to form a reel by passing the web through a first reeling nip, forming said first reeling nip between the reel and a first set of belt rolls extending in a cross direction of said reel drum substantially across a width of the web at least as the web is being reeled around said reel drum, and forming a second reeling nip between the reel and a second set of belt rolls.

12. The method of claim 11, further comprising the step of rotating said reel drum by means of center drive.

13. The method of claim 11, further comprising the step of regulating the position of said first set of belt rolls by displacing an end of said first set of belt rolls to different positions relative to the web.

14. The method of claim 11, further comprising the step of regulating the tension of belts in said first set of belt rolls such that a load in said first reeling nip is regulatable.

15. The method of claim 11, further comprising the step of profiling a load in said first reeling nip in a cross direction of the web by regulating a load of belts in said first set of belt rolls.

16. The method of claim 11, further comprising the step of recording and/or storing information relating to reeling of the web and subsequently using the recorded and/or stored information while unwinding the web from the reel.

17. A method for unwinding a web from a reel formed around a reel drum, comprising the steps of:

supporting said reel drum on rails, unwinding the web from the reel by passing the web through a first reeling nip, forming the first reeling nip between the reel and a first set of belt rolls extending in a cross direction of said reel drum substantially across a width of the web at least as the web is being unwound from said reel drum, and forming a second reeling nip between the reel and a second set of belt rolls.

18. The method of claim 17, further comprising the step of rotating said reel drum by means of center drive.

19. The method of claim 17, further comprising the step of regulating the position of said first set of belt rolls by displacing an end of said first set of belt rolls to different positions relative to the web.

20. The method of claim 17, further comprising the step of recording and/or storing information relating to reeling of the web and using the recorded and/or stored information while unwinding the web from the reel drum.

21. A reeling device in which a continuous web is reeled, comprising a reel drum arranged such that the web is passed through a reeling nip and reeled onto said reel drum to form a reel, support means for at least partially supporting said reel drum at its ends, at least one set of belt rolls extending in a cross direction of the reel device substantially across a width of the web and arranged to engage the web at least as the web is being reeled onto said reel drum such that said at least one set of belt rolls defines in part said reeling nip, each of said at least one set of belt rolls comprising an actuator for displacing an end of said set of belt rolls to different positions relative to the web, and rotation means coupled to said reel drum for providing said reel drum with center drive.

22. The reeling device of claim 21, wherein said support means comprises a rail arranged on each side of said reel drum.

23. The reeling device of claim 21, wherein said at least one set of belt rolls comprises first and second sets of belt rolls arranged one after the other in a running direction of the web.

24. The reeling device of claim 21, wherein each of said at least one set of belt rolls comprises at least two rolls and at least one rotatable belt arranged to run in a loop around said at least two rolls.

25. The reeling device of claim 24, wherein each of said at least one set of belt rolls comprises a tension regulation member for regulating tension of said at least one belt.

26. The reeling device of claim 21, wherein each of said at least one set of belt rolls comprises at least two rolls and a plurality of rotatable belts arranged side by side and to run in a loop around said at least two rolls.

27. The reeling device of claim 21, further comprising a frame construction, each of said at least one set of belt rolls comprising articulated coupling means for linking said set of belt rolls to said frame construction by means of an articulated joint.

28. An unwinding device in which a continuous web is unwound from a reel formed around a reel drum, comprising support means for supporting said reel drum, at least one set of belt rolls extending in a cross direction of the reel device substantially across a width of the web and arranged to engage the web at least as the web is being unwound from the reel, said at least one set of belt rolls defining a nip with the reel through which the web is passed as it is unwound from the reel, each of said at least one set of belt rolls comprising an actuator for displacing an end of said set of belt rolls to different positions relative to the web, and rotation means coupled to said reel drum for providing said reel drum with center drive.

29. A method for transferring reeling of a web from a first reel drum to a second reel drum without substantially changing the speed of the web from its reeling speed, comprising the steps of:

reeling the web around the first reel drum to form a reel by passing the web through a first reeling nip formed between the reel and a set of belt rolls extending in a cross direction of the first reel drum substantially across a width of the web, as the first reel drum becomes full, accelerating the second reel drum and then moving the set of belt rolls to form a second reeling nip between the set of belt rolls and the second reel drum in advance of the first reeling nip in the direction of the web, while the set of belt rolls forms both first and second reeling nips, terminating the reeling of the web onto the first reel drum and commencing the reeling of the web onto the second reel drum, and moving the first reel drum out of nip-contact with the set of belt rolls.

* * * * *